US007455295B2

(12) United States Patent
Marx et al.

(10) Patent No.: US 7,455,295 B2
(45) Date of Patent: Nov. 25, 2008

(54) NIP PRESSURE

(75) Inventors: Martin J. Marx, Gardon Valley, ID (US); Robert W. Jewell, Meridian, ID (US); Nathan R. Stoddard, Boise, ID (US); Alfred D. Kirby, Boise, ID (US); Steven J. Beutler, Meridan, ID (US); Jeff D. Ward, Meridian, ID (US); Clinton Troy Jensen, Caldwell, ID (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 318 days.

(21) Appl. No.: 11/199,837

(22) Filed: Aug. 8, 2005

(65) Prior Publication Data

US 2007/0029725 A1 Feb. 8, 2007

(51) Int. Cl.
*B65H 5/02* (2006.01)

(52) U.S. Cl. ..... 271/273; 271/274; 271/272; 271/902

(58) Field of Classification Search ..... 271/272, 271/273, 274, 902, 314, 225; 399/397, 400; 198/624, 608, 626.4, 626.6
See application file for complete search history.

(56) References Cited

U.S. PATENT DOCUMENTS 2,974,952 A * 3/1961 Zeuthen ..... 271/242
3,241,665 A * 3/1966 Erk ..... 209/577
4,155,545 A * 5/1979 Yanagawa et al. ..... 271/10.09
4,269,594 A * 5/1981 Umans et al. ..... 432/59
4,470,349 A * 9/1984 Godlewski ..... 101/233
4,491,887 A * 1/1985 Sato ..... 360/90
4,558,373 A * 12/1985 Plasencia et al. ..... 358/484
4,627,607 A * 12/1986 Ishii ..... 271/122
4,958,195 A * 9/1990 Firth et al. ..... 399/332
5,011,129 A * 4/1991 Holbrook ..... 271/274
5,023,667 A * 6/1991 Negoro et al. ..... 399/317
5,030,025 A * 7/1991 Mitcham et al. ..... 400/636
5,087,947 A * 2/1992 Torino ..... 399/322
5,209,465 A * 5/1993 Sayama et al. ..... 271/110
5,221,035 A * 6/1993 Suzuki et al. ..... 226/181
5,235,381 A * 8/1993 Namiki et al. ..... 355/72
5,368,285 A * 11/1994 Kusumoto ..... 271/9.01
5,406,362 A * 4/1995 Mills ..... 399/126
5,488,467 A * 1/1996 Marentes et al. ..... 399/68
5,725,208 A * 3/1998 Miyauchi ..... 271/10.09
5,833,108 A * 11/1998 Chinzei et al. ..... 226/177
5,915,691 A * 6/1999 Deguchi et al. ..... 271/265.01
6,007,063 A * 12/1999 Park ..... 271/273
6,042,112 A * 3/2000 Izumi ..... 271/273
6,338,483 B1 * 1/2002 Andela et al. ..... 271/227
6,446,960 B1 * 9/2002 Okada ..... 271/240
6,526,239 B2 * 2/2003 Shiiya ..... 399/67
6,641,132 B2 * 11/2003 Sekine ..... 271/124
6,817,611 B2 * 11/2004 DiRamio ..... 271/273
6,834,854 B2 * 12/2004 Inoue et al. ..... 271/242
7,090,215 B2 * 8/2006 Mandel et al. ..... 271/273

(Continued)

FOREIGN PATENT DOCUMENTS

JP 60077046 A * 5/1985

(Continued)

*Primary Examiner*—Patrick H Mackey
*Assistant Examiner*—Luis Gonzalez

(57) ABSTRACT

Embodiments of example apparatuses and methods for changing nip pressure are described.

11 Claims, 4 Drawing Sheets

U.S. PATENT DOCUMENTS

| | | | | |
|---|---|---|---|---|
| 7,255,340 | B2 * | 8/2007 | Anezaki et al. | 271/176 |
| 7,325,802 | B2 * | 2/2008 | Asakawa et al. | 271/273 |
| 2003/0122913 | A1 * | 7/2003 | Lee et al. | 347/104 |
| 2004/0156660 | A1 * | 8/2004 | Fuma et al. | 399/328 |
| 2004/0190958 | A1 * | 9/2004 | Matsumoto | 399/329 |
| 2004/0251618 | A1 * | 12/2004 | Niizeki | 271/272 |
| 2004/0252354 | A1 * | 12/2004 | Shimizu | 358/496 |
| 2005/0067775 | A1 * | 3/2005 | Ono | 271/272 |
| 2005/0133991 | A1 * | 6/2005 | Ata et al. | 271/273 |
| 2005/0280206 | A1 * | 12/2005 | Ahn et al. | 271/273 |
| 2006/0071419 | A1 * | 4/2006 | Lee | 271/272 |
| 2006/0181015 | A1 * | 8/2006 | Takahashi | 271/273 |
| 2007/0018385 | A1 * | 1/2007 | Park | 271/272 |

FOREIGN PATENT DOCUMENTS

| | | | |
|---|---|---|---|
| JP | 01098540 | A * | 4/1989 |

* cited by examiner

NIP PRESSURE

BACKGROUND

Rotatable members, such as those found in imaging devices, may wear or be damaged in different ways. In some instances, in removing media jammed in a nip between rotatable members, a user may damage one or more of the rotatable members. Moreover, nip pressure between rotatable members may, over time, damage one or more of the rotatable members.

DETAILED DESCRIPTION OF EXAMPLE EMBODIMENTS

Figure 1:
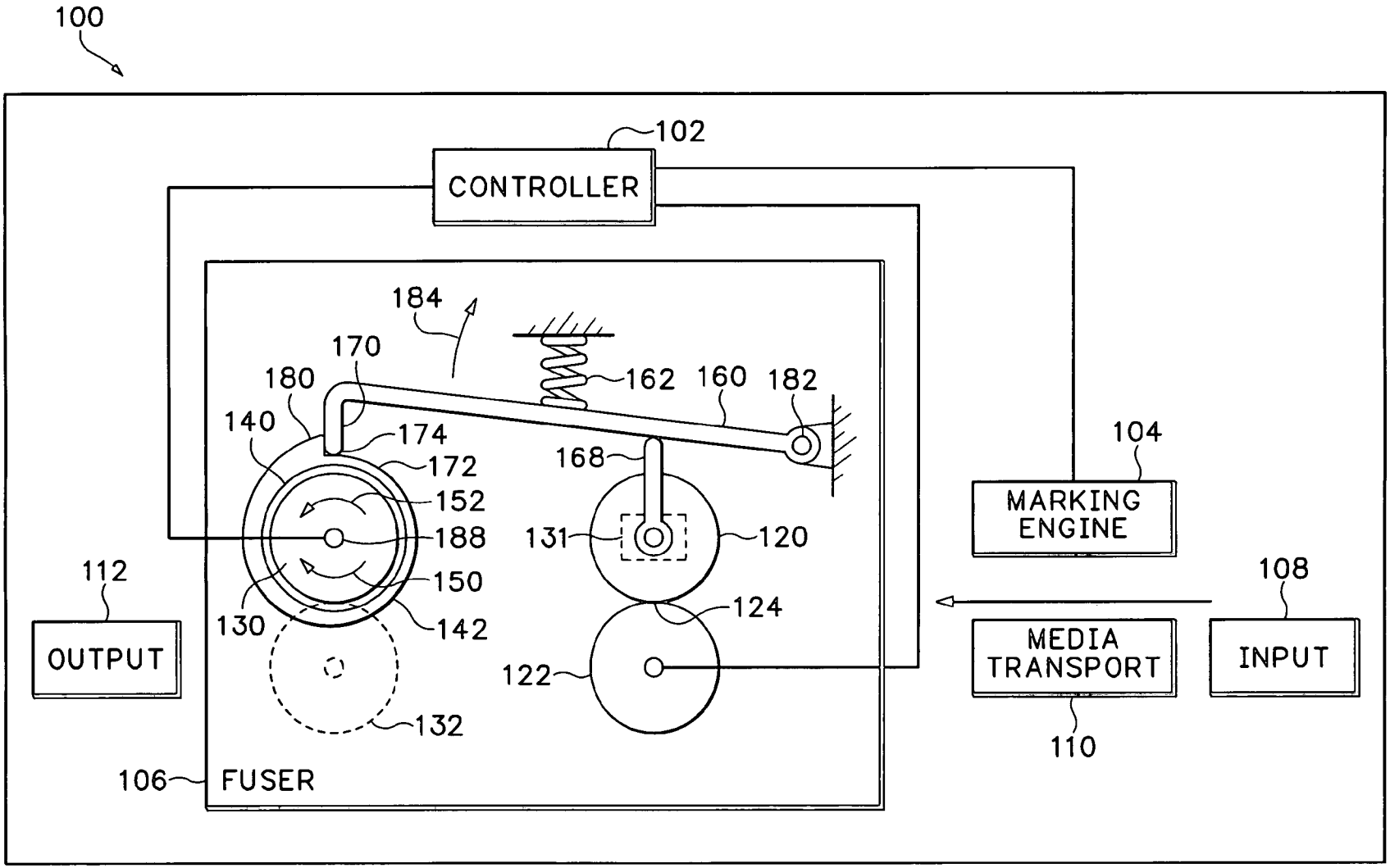
FIG. 1 illustrates an example embodiment of an imaging device.

FIG. 1 illustrates an example embodiment of an imaging device 100. The imaging device 100 includes a controller 102, a marking engine 104, a fuser 106, a media input 108, a media transport 110, and a media output 112. In some embodiments, sheets of media are stacked at the input 108 and are advanced by the media transport 110 to a marking engine 104. The marking engine 104 deposits toner (not shown) or other suitable marking material on the media. The media then passes through the fuser 106 to the output 112. Additional media handling devices (not shown) may be used to advance the media from the fuser 106 to the output 112.

The fuser 106 includes rotatable members 120, 122. A nip 124 may be formed between the rotatable members 120, 122. A nip pressure may exist between the rotatable members 120, 122 at nip 124. The nip 124 in FIG. 1 is shown as being part of the fuser 106, but other nips such as media registration nips, may have the nip pressure changed as described herein. Hence, embodiments showing the nip 124 as part of a fuser are to be understood as example, non-limiting embodiments.

The rotatable members 120, 122 may be used in some embodiments to fuse the toner using heat and pressure. As such, a heating element 131 may be positioned proximate one or both of the rotatable members 120, 122. In the example embodiment of FIG. 1, the heating element 131 may be disposed inside the rotatable member 120. The heating element 131 may also be positioned outside, but adjacent to, the rotatable member 120. Pursuant to some embodiments one or more of the rotatable members may comprise a polyester tube, a ceramic bar, or the like.

The fuser 106 is also shown as including exit rollers 130, 132. The exit rollers 130, 132 may be used for advancing fused media from the rotatable members 120, 122 towards the output 112. In the example embodiment shown in FIG. 1, the roller 130 is a driven roller and the roller 132 is an idler roller. The roller 132 is shown in dashed lines for ease of illustrating other components.

A directionally-clutched cam 142 is coupled to the roller 130. In some embodiments, a directionally-clutched cam 142 may be mounted on each end of the roller 130. As shown in FIG. 1, the cam 142 is mounted to the roller 130 by a one-way clutch 140. The one-way clutch 140 may comprise, in some embodiments, a one-way bearing.

The cam 142 is directionally-clutched such that when the roller 130 rotates in the direction 150 there is substantially free movement between the roller 130 and the cam 142 such that very little, if any, rotational power from the roller 130 is transferred to the cam 142 via the clutch 140. When the roller 130 rotates in the direction 152, however, the clutch 140 engages and causes the cam 142 to rotate in the direction 152.

In some embodiments, the clutch 140 comprises a one-way bearing that functions by riding on a shaft, such as roller 130, that passes through the clutch 140. The bearing rotates freely in one rotational direction but locks in the other, opposite rotational direction. Example one-way bearings may comprise numerous rollers, or needle, bearings, inside a case. The shape of the race allows the bearings to rotate in one direction but not the other. The clutch 140 may comprise any suitable one-way bearing. The clutch 140 may alternatively comprise a one-way clicker system or other suitable one-way clutch.

An arm 160 is pivotally disposed at the fuser 106 and may be pivoted about pivot 182 relative to the nip 124. As shown in FIG. 1, the arm 160 is biased toward the nip 124 by a bias member 162. The bias member 162 may comprise a spring.

The rotatable member 120 is shown as being coupled to support 168. The arm 160, as biased by the bias member 162, may exert a force on the support 168 in a direction substantially towards the nip 124. In some embodiments, the support 168 and the arm 160 are discrete components that are configured to selectively contact each other. In other embodiments, the support 168 and the arm 160 are formed as a single part.

Figure 2:
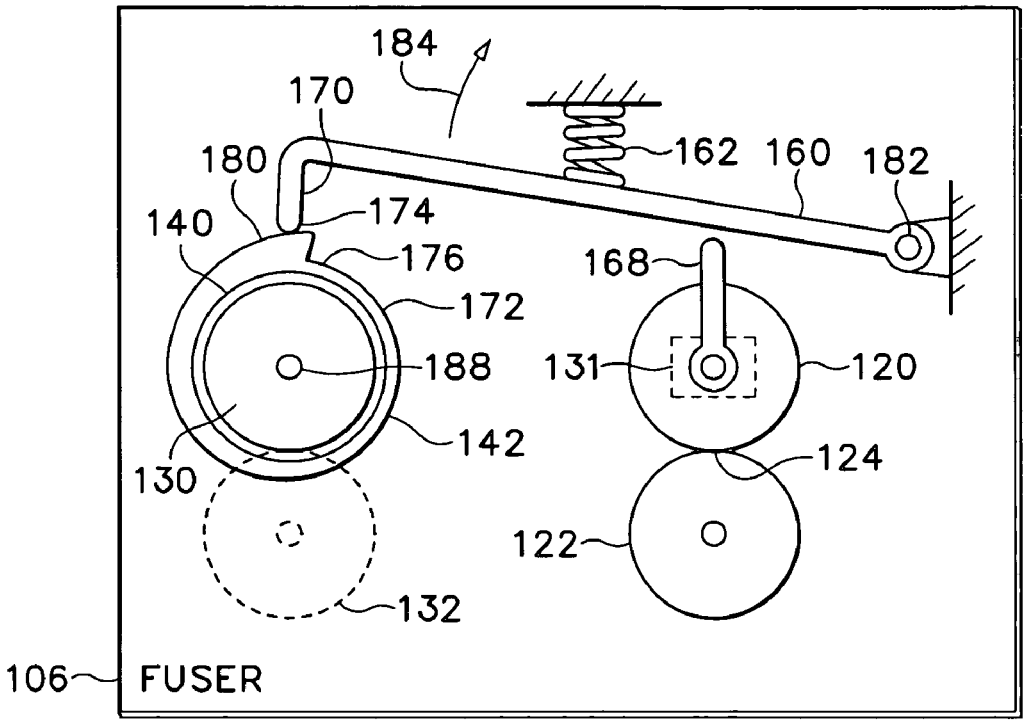
FIG. 2 illustrates an example embodiment of a fuser.

The arm 160 also includes lifter 170. An end 174 of the lifter 170 is in contact with a surface 172 of the cam 142. As the cam 142 rotates in the direction 152, the end 174 of the lifter 170 slides on the surface 172 of the cam 142. Further, as the cam 142 rotates in the direction 152, the end 174 of the lifter 170 moves substantially vertically due to cam surface 172. For example, when the end 174 of the lifter 170 is positioned at the location shown in FIG. 1, the end 174 is in a lowered position. When the cam surface 172 is rotated such that the end 174 of the lifter 170 is at or near the location 180, the end 174 is in a raised position (FIG. 2).

The cam surface 172 has a profile such that the radial distance from the axis of rotation 188 of the roller 130 to the surface 172 varies with angular position. For the example cam 142 shown in FIG. 1, this radial distance is at or near a maximum at the location 180 and is at or near a minimum value at the location 176 (FIG. 2). The profile of cam surface 172 is an example profile. Cams having different profiles from that of example cam 142 may be alternatively employed.

As the end 174 of the lifter 170 moves from the position shown in FIG. 1 to the location 180, the lifter 170 rises and causes the arm 160 to pivot or rotate about pivot 182 in the direction of arrow 184, thereby compressing the bias member 162 and reducing the pressure at the nip 124.

Controller 102 comprises a processing unit configured to generate control signals directing the operation of the roller 130, rotatable member 122, marking engine 104, and media transport 110. For purposes of this disclosure, the term "processing unit" shall include a processing unit that executes sequences of instructions contained in a memory. Execution of the sequences of instructions causes the processing unit to perform steps such as generating control signals. The instructions may be loaded in a random access memory (RAM) for execution by the processing unit from a read only memory (ROM), a mass storage device, or some other persistent storage. In other embodiments, hard wired circuitry may be used in place of or in combination with software instructions to implement the functions described. Controller 102 is not limited to any specific combination of hardware circuitry and software, nor to any particular source for the instructions executed by the processing unit. In one embodiment, controller 102 receives image, or print job, data and generates control signals based upon the data. Moreover, the controller 102 may include a computer readable medium having instructions, such as in the form of firmware, for performing the methods disclosed herein.

In operation, the controller 102 controls the direction of rotation of the roller 130. Normally, the controller 102 directs the roller 130 to rotate in the direction 150. In response to a condition or status of the device 100, the controller 102 directs the roller 130 to rotate in the direction 152. As discussed above, due to the one-directional nature of clutch 140, when the roller 130 rotates in the direction 152, the cam 142 also rotates in the direction 152, thereby raising the lifter 170 and lifting the arm 160 in the direction 184. Movement of the arm 160 in the direction 184 compresses the bias member 162 and thereby reduces the pressure at the nip 124.

Reduction of pressure at the nip 124 may facilitate removal of media disposed in the nip 124. Further reduction of pressure at the nip 124 may reduce wear on or damage to one or both of the rotatable members 120, 122. In some embodiments, to reduce the effect of stationary nip pressure on one or both of the rotatable members 120, 122, the nip pressure at the nip 124 may be reduced while the device 100 is idle or otherwise not in a printing status. Further, in some embodiments, nip pressure at the nip 124 is reduced in response to detection of jammed media to permit jammed media to be removed with potentially less damage to the rotatable members 120, 122.

FIG. 2 illustrates an embodiment of the fuser 106 according to an example embodiment. In FIG. 2, the cam 142 is rotated such that the end 174 of the lifter 170 is positioned at or near location 180. Thus, compared to the position shown in FIG. 1, the lifter 170 and arm 160 are rotated or pivoted in the direction 184. With the arm 160 in the position shown in FIG. 2, the bias member 162 is more compressed than when the arm 160 is in the position shown in FIG. 1. The additional compression of the bias member 162 by the arm 160 reduces the pressure at the nip 124. In the embodiment shown in FIG. 2, rotation of the arm 160 in the direction 184 reduces the force with which the arm 160 presses on the support 168. FIG. 2 shows an embodiment where the arm 160 is moved in the direction 184 to an extent that the arm 160 is moved out of contact with the support 168. In other embodiments, however, moving the arm 160 in the direction 184 does not move the arm 160 out of contact with the support 168. Consequently, in the example embodiment shown in FIG. 2, the bias member 162 does not bias the rotatable member 120 when the cam 142 is positioned as shown in FIG. 2. Instead, the bias member 162 biases the rotatable member 120 when the cam 142 is in the position shown in FIG. 1.

Figure 3:
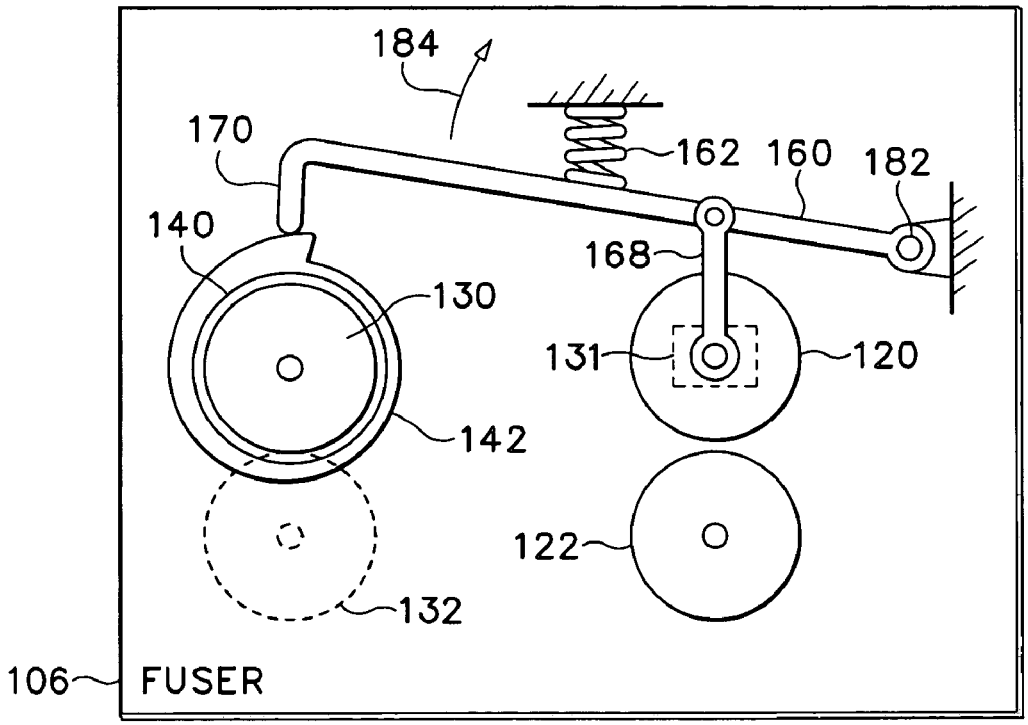
FIG. 3 illustrates an example embodiment of a fuser.

FIG. 3 illustrates another embodiment of fuser 106. The embodiment of FIG. 3 is configured the same as the embodiment of FIG. 2, except as follows. The arm 160 and the support 168 are connected such that when the arm 160 is moved in the direction 184 by the cam 142 the arm 160 lifts the support 168 from the position shown in FIG. 1 to the position shown in FIG. 3. In this embodiment, the support 168 may lift the rotatable member 120 out of contact with the rotatable member 122. In some modes of operation, however, the support 168 shown in FIG. 3 does not lift the rotatable member 120 out of contact with the rotatable member 122, but rather moves enough to significantly reduce the pressure at the nip 124 (FIG. 1).

Figure 4:
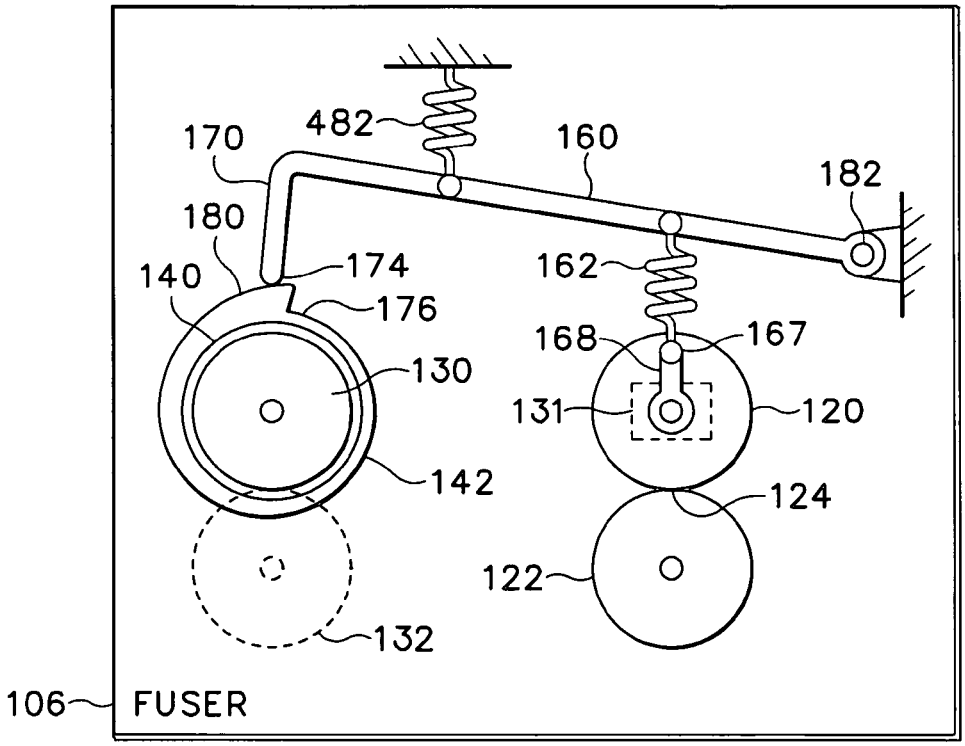
FIG. 4 illustrates an example embodiment of a fuser.

FIG. 4 illustrates yet another embodiment of fuser 106. In this embodiment, the bias member 162 is disposed between arm 160 and support 168 such that as the cam 142 rotates, the arm 160 is moved to change the compression in the bias member 162, thereby changing the pressure at the nip 124. In particular, the bias member 162 is shown as having one end coupled to the arm 160 and another end coupled to the support 168 at location 167. A bias member 482, such as a spring, is also shown as coupled to the arm 160 to bias the arm 160 toward the roller 130. The pressure at the nip 124 can be increased by rotating the cam 142 to position the end 174 of the lifter 174 at or near the location 176, which increases the compression of the bias member 162. Conversely, the pressure at the nip 124 can be reduced by positioning the cam 142 such that the end 174 is at or near the location 180. In this embodiment, the bias member 162 and the rotatable member 120 are below the arm 160.

Figure 5:
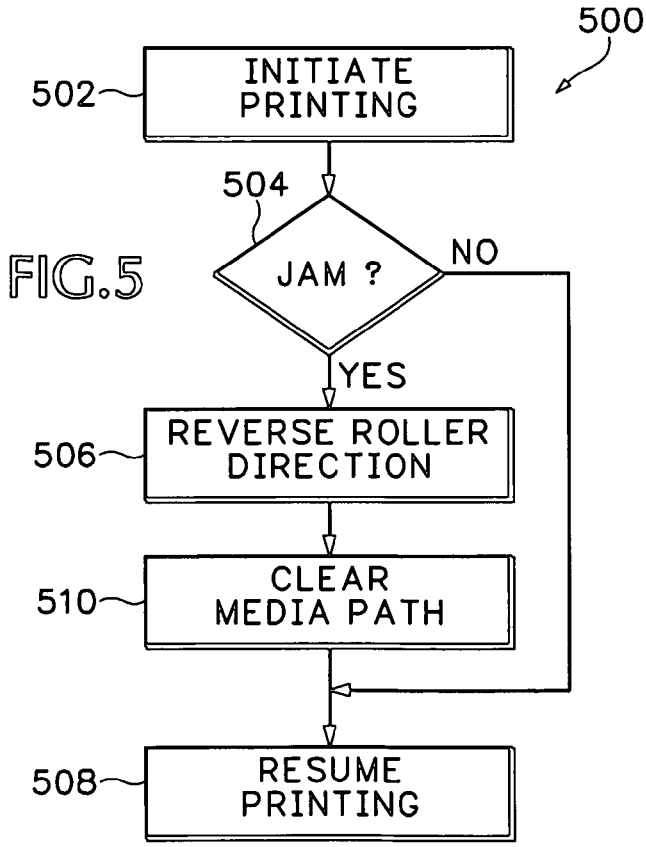
FIG. 5 illustrates an example embodiment of a method.

FIG. 5 illustrates a method 500 in accordance with an example embodiment. In this embodiment, a printing operation begins at block 502. The operation of block 502 may be performed, in some embodiments, by the controller 102. The beginning of the printing operation may include advancing media from the input 108 (FIG. 1) toward the marking engine 104, depositing toner on the media, or both. Next, at block 504 the device 100 determines whether a jam is detected. In some embodiments, a jam is detected when stalled media is detected in a media path of the device 100, such as via media position sensors, media position flags, or the like. If a jam is detected at block 504, execution proceeds to block 506, else execution proceeds to block 508. At block 506 a direction of rotation of a roller is reversed to reduce nip pressure. As discussed above, the roller 130, when rotated in direction 152 reduces the pressure at the nip 124. At block 510, a user may clear a media path. Block 510 is optional. Next, at block 508, printing is resumed. Accordingly, by reversing a rotational direction of the roller 130 in response to detecting a jam may result in a significant reduction of pressure at the nip 124.

Figure 6:
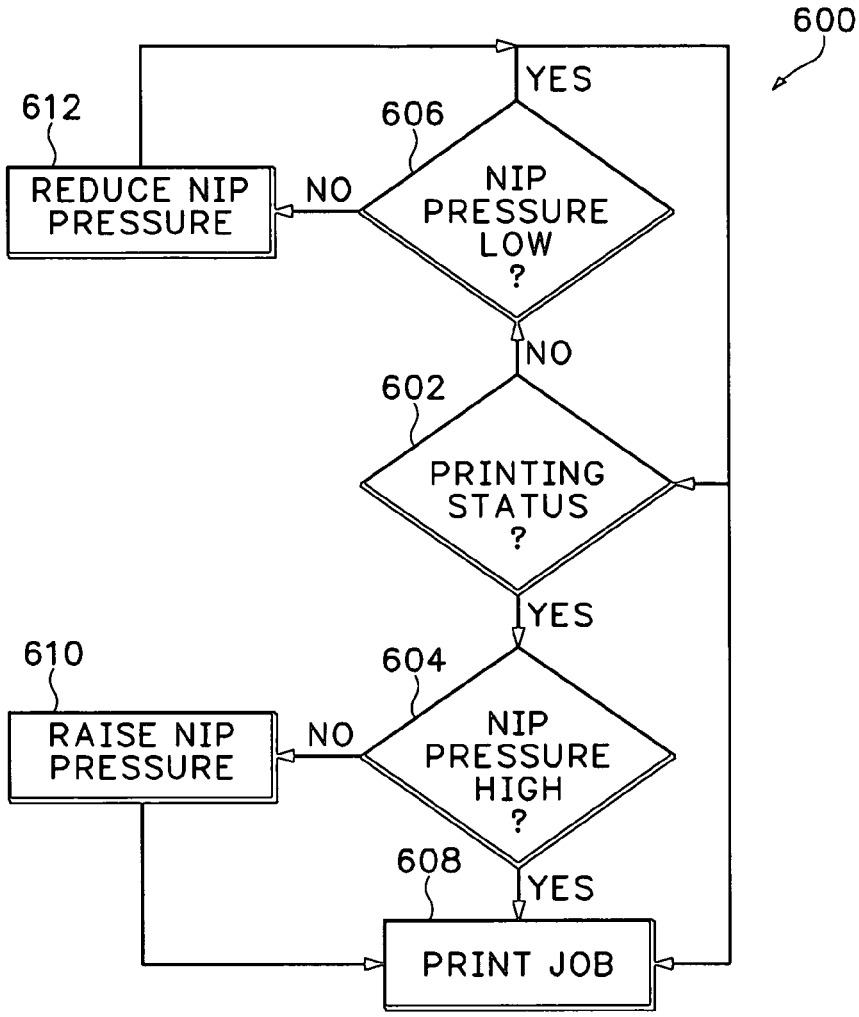
FIG. 6 illustrates an example embodiment of a method.

FIG. 6 illustrates a method 600 in accordance with an example embodiment. The method commences at block 602 with a determination as to the printing status of a device, such as the device 100 (FIG. 1). A printing status is present when the device 100 is printing, has a print job in queue, or both. Otherwise, the device 100 has a non-printing status. If, pursuant to block 602, it is determined that a printing status is present, execution proceeds to block 604, else execution proceeds to block 606. In some embodiments, the determination of block 602 may be performed by controller 102 (FIG. 2).

At block 604, a determination is made as to whether a nip pressure is high. Whether a nip pressure is high may be determined by whether the rotatable members forming the nip are positioned and/or biased in a predetermined fashion such that a nip pressure between the rotatable members is sufficient. In an example embodiment, the nip pressure may comprise the nip pressure at the nip 124 (FIG. 1). The determination of block 604 may be performed by the controller 102 (FIG. 1). In some embodiments, the nip pressure is determined to be high when the cam 142 is positioned at or near the position shown in FIG. 1. Similarly, in some embodiments, the nip pressure is determined to not be high when the cam 142 is positioned at a significantly different position compared to the position shown in FIG. 1. If the nip pressure is determined to be high, pursuant to block 604, execution proceeds to block 608, else execution proceeds to block 610. At block 608, printing of a print job occurs or continues and then execution returns to block 602.

At block 610, nip pressure is raised. In some embodiments, the nip pressure is raised by rotating the cam 142 to a position substantially similar to the position shown in FIG. 1. Once the cam 142 is in a position substantially similar to the position shown in FIG. 1, execution proceeds to block 608.

As mentioned above, if, pursuant to block 602, it is determined that a printing status is present, execution proceeds to block 604, else execution proceeds to block 606. At block 606, it is determined if the nip pressure is low. In some embodiments, the nip pressure is determined to be low when the cam 142 is positioned a significant radial distance from the position shown in FIG. 1. If, pursuant to block 606, the nip pressure is not determined to be low, the nip pressure is reduced at block 612. The nip pressure may be increased, for example, by techniques described above. If, pursuant to block 606, the nip pressure is determined to be low, execution returns to block 602.

Figure 7:
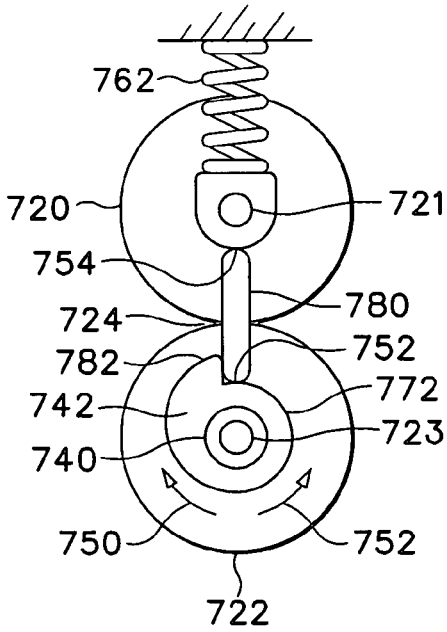
FIG. 7 illustrates an example embodiment of a nip.

FIG. 7 illustrates an example nip 724 formed between rotatable members 720, 722. The rotatable members 720, 722 may comprise any suitable set of rotatable members. In some embodiments, the rotatable members 720, 722 comprise fuser elements. In other embodiments, the rotatable members 720, 722 comprise rollers for advancing media along a media path in an imaging device.

In particular, the rotatable member 720 rotates about shaft 721. The rotatable member 722 rotates about shaft 723. A one-way clutch 740, such as a one-way bearing or other suitable clutch, is coupled to the shaft 723. The one-way clutch 740 is configured to permit a cam 742 to rotate freely relative to the shaft 723 when the shaft 723 rotates in the direction 750, but causes cam 742 to rotate in direction 751 when the shaft 723 rotates in the direction 751.

A bias member 762 biases the rotatable member 720 toward the rotatable member 722. In some embodiments, the bias member 762 comprises a spring. The bias member 762 engages the shaft 721, such as via a bearing (not shown), to bias the shaft 721, and thus the rotatable member 720 toward the rotatable member 722.

A separator member 780 is shown as being disposed between the cam 742 and the shaft 721. In particular, the separator member has ends 752, 754. The end 752 of the separator member 780 contacts a cam surface 772 of the cam 742 and the end 754 of the separator member 780 is coupled to the shaft 721. In some embodiments, the separator member is coupled to the shaft 721 via a bearing (not shown) or other suitable mechanism.

In this configuration, when the cam 742 is in the position shown in FIG. 7, the bias member 762 biases the rotatable member 720 toward the rotatable member 722, thereby forming a nip pressure at the nip 724. When the shaft 723 rotates in the direction 750, the shaft 723 imparts little, if any rotational power to the cam 742 and, thus, the cam 742 remains substantially stationary. When the shaft 723 rotates in the direction 751, the one-directional clutch 740 causes the cam 742 to also rotate in the direction 751. As the cam 742 rotates in the direction 751, the cam surface 772 causes the separator member 780 to move away from the axis of rotation of the shaft 723, which moves the shaft 721 away from the shaft 723, thereby reducing the nip pressure at the nip 724. In some embodiments, when the end 752 is positioned at or near location 782 of the cam surface 722, the rotatable member 720 may separate from the rotatable member 722 such that a gap or space forms between the rotatable members 720, 722. In other embodiments, however, the rotatable members 720, 722 remain in contact, but with less nip pressure, when the end 752 of the separator member 780 is at or near the location 782. When the cam 742 is positioned at or near the position shown in FIG. 7, the nip pressure at the nip 724 is at or near a maximum for the cam configuration shown in FIG. 7. Of course, other cam profiles may be alternatively employed.

Although the present disclosure has been described with reference to example embodiments, workers skilled in the art will recognize that changes may be made in form and detail without departing from the spirit and scope of the claimed subject matter. For example, although different example embodiments may have been described as including one or more features providing one or more benefits, it is contemplated that the described features may be interchanged with one another or alternatively be combined with one another in the described example embodiments or in other alternative embodiments. The present disclosure described with reference to the example embodiments and set forth in the following claims is manifestly intended to be as broad as possible. For example, unless specifically otherwise noted, the claims reciting a single particular element also encompass a plurality of such particular elements.

We claim:

1. An apparatus, comprising:

a roller configured to contact a print media;

a rotatable member configured to contact the print media;

a one-way clutch coupled to the rotatable member;

a cam coupled to the clutch and configured to maintain a nip pressure at the roller when the rotatable member rotates in a first direction and to reduce the nip pressure at the roller when the rotatable member rotates in a second direction;

an additional roller configured to contact the print media, wherein the nip pressure is established between the roller and the additional roller;

an arm coupled to the roller and configured to pivot relative to the roller and the additional roller; and a bias member coupled to the arm.

2. The apparatus of claim 1, further comprising:

a bias member coupled to the roller.

3. An apparatus, comprising:

a roller configured to contact a print media;

a rotatable member configured to contact the print media;

a one-way clutch coupled to the rotatable member;

a cam coupled to the clutch and configured to maintain a nip pressure at the roller when the rotatable member rotates in a first direction and to reduce the nip pressure at the roller when the rotatable member rotates in a second direction;

an additional roller configured to contact the print media, wherein the nip pressure is established between the roller and the additional roller;

an arm configured to pivot relative to the roller and the additional roller; and a bias member coupled to the arm to bias the arm toward the roller.

4. The apparatus of claim 3, wherein the roller has a heating element disposed therein.

5. The apparatus of claim 3, further comprising:

a media input configured to supply the print media; and a print engine configured to print on the print media;

the roller and the additional roller comprising fuser rollers, and the nip pressure comprising a pressure between the fuser rollers.

6. The apparatus of claim 3, further comprising a controller configured to reverse a direction of rotation of the rotatable member in response to detecting a jam condition.

7. The apparatus of claim 3, further comprising a controller configured to reverse a direction of rotation of the rotatable member in response to a change in printing status.

8. The apparatus of claim 3, wherein the rotatable member is configured to contact the print media after the roller contacts the print media.

9. The apparatus of claim 1, wherein the roller has a heating element disposed therein.

10. The apparatus of claim 1, further comprising a controller configured to reverse a direction of rotation of the rotatable member in response to detecting a jam condition.

11. The apparatus of claim 1, further comprising a controller configured to reverse a direction of rotation of the rotatable member in response to a change in printing status.

* * * * *